US008820617B2

(12) United States Patent
Silverstein et al.

(10) Patent No.: US 8,820,617 B2
(45) Date of Patent: Sep. 2, 2014

(54) CARTON WITH TAMPER EVIDENT PRIZE INFORMATION FEATURE

(75) Inventors: Barry L. Silverstein, Northbrook, IL (US); Matthew R. Cook, Hinsdale, IL (US); Lauren Mikos, Chicago, IL (US); Ivette Morales, Chicago, IL (US); James A. Hubbard, Jr., Oak Lawn, IL (US)

(73) Assignee: LBP Manufacturing, Inc., Cicero, IL (US)

( * ) Notice: Subject to any disclaimer, the term of this patent is extended or adjusted under 35 U.S.C. 154(b) by 272 days.

(21) Appl. No.: 12/728,712

(22) Filed: Mar. 22, 2010

(65) Prior Publication Data

US 2010/0243719 A1 Sep. 30, 2010

Related U.S. Application Data

(60) Provisional application No. 61/162,943, filed on Mar. 24, 2009.

(51) Int. Cl.
*B65D 5/42* (2006.01)
*B65D 5/54* (2006.01)
*B31B 1/88* (2006.01)

(52) U.S. Cl.
USPC ..... 229/102; 229/200; 493/53

(58) Field of Classification Search
USPC ..... 229/102, 200, 902, 906, 175, 919; 493/53; 206/831
See application file for complete search history.

(56) References Cited

U.S. PATENT DOCUMENTS

| | | | | |
|---|---|---|---|---|
| 4,004,691 | A | 1/1977 | Wihksne | |
| 4,472,896 | A * | 9/1984 | Brauner et al. | 40/312 |
| 4,684,023 | A * | 8/1987 | Cortopassi | 206/459.1 |
| 6,027,018 | A | 2/2000 | Yocum | |
| 6,041,997 | A | 3/2000 | Jensen | |
| 2007/0267468 | A1 * | 11/2007 | Burke et al. | 229/146 |

OTHER PUBLICATIONS

International Search Report of May 21, 2010 and Written Opinion of Sep. 24, 2011 for PCT/US2010/028304.

* cited by examiner

*Primary Examiner* — Gary Elkins
*Assistant Examiner* — Christopher Demeree
(74) *Attorney, Agent, or Firm* — Brinks Gilson & Lione

(57) ABSTRACT

A carton including a top and bottom portion adapted to secure an item within the top and bottom portion in a closed configuration. The carton also includes an information tab defined in a first surface of the top portion. The information tab is defined via series of perforated edges. An information tab cover on the carton is defined by a series of perforated edges that enable at least partial separation of the information tab from the carton. When the carton is in an unassembled configuration, a surface of the information tab is exposed to enable placement of information on the information tab. When the carton is in an assembled configuration the information tab cover covers the surface of the information tab so that the information placed on the information tab is not visible.

8 Claims, 7 Drawing Sheets

CARTON WITH TAMPER EVIDENT PRIZE INFORMATION FEATURE

RELATED APPLICATIONS

This application claims the benefit of the filing date of U.S. Provisional Patent Application No. 61/162,943, filed Mar. 24, 2009, the contents of which are hereby incorporated by reference.

BACKGROUND

Cartons, such as clamshell cartons, are utilized in food service industries to hold various food items, such as hamburgers and hotdogs. Typical cartons are made from card board. Printing may be provided on one side of the carton to identify the food item within the carton.

In an effort to improve food item sales, various promotional techniques may be employed, such as providing prizes to those that purchase the food items. The prize may be indicated on a tamper evident sticker attached to the side of the carton. To determine whether a prize may have been won, a consumer peals back a tab on the tamper evident sticker to reveal the prize if any.

Alternatively, the prize information may simply be printed on the carton. For example, a code may be printed on the side of the carton. After purchasing the food item, the consumer enters the code on an online website to determine whether he has won a prize.

Typically, the consumer must hold onto the carton until he has time to redeem any prize that may be offered. But most cartons are bulky. The carton may also be carrying remnants of the food item previously stored in the carton, such as ketchup and mustard. This leads to sanitary problems if the consumer must hold onto the container for an extended period of time.

In addition, tamper evident stickers require an additional operation in the manufacturing process, namely that the sticker be placed on the carton. While printing directly on a carton solves this problem, a new problem is created in that employees of the restaurant selling the food item may simply identify cartons associated with winning prizes and may try to redeem the prize for themselves, thus depriving the restaurant of any benefits associated with the prize.

BRIEF DESCRIPTION OF THE DRAWINGS

The components in the figures are not necessarily to scale, emphasis instead being placed upon illustrating the principles of the design. Moreover, in the figures, like referenced numerals designate corresponding parts throughout the different views.

DETAILED DESCRIPTION

The exemplary embodiments below describe a food carton with an integrated prize information feature. The top portion of the food carton includes an information tab and an information tab cover that covers prize information printed or placed on the information tab. The information tab and the information tab cover may be placed on a different portion of the carton.

The information tab cover is configured to be removable by a user to enable the user to view the prize information. In some embodiments, the information tab is also removable.

In an unassembled configuration, the carton is substantially flat. The prize information and other information may be printed on the flattened carton during a single printing operation.

Figure 1:
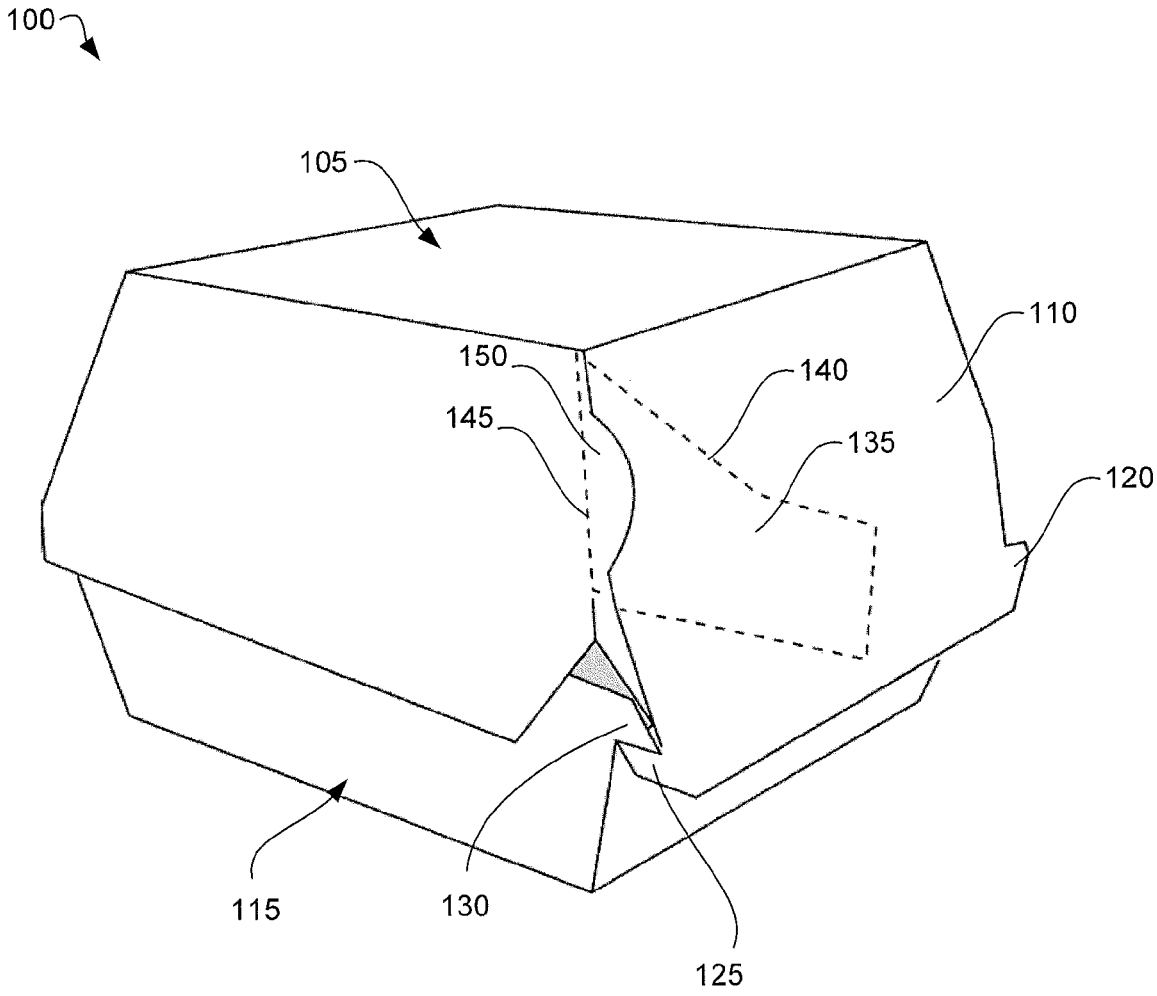
FIG. 1 is a perspective view of a carton with a tamper evident prize information feature.

FIG. 1 is a perspective view of a carton 100 with a tamper evident prize information feature. The carton 100 includes a top portion 105 and bottom portion 115. The top portion 105 includes a front surface 110 that defines a plurality of locking fingers 120 and 125, and an information tab cover 135 that covers prize information printed on a prize information tab 150. The information tab cover 135 prevents one from seeing the prize information printed on the prize information tab 150.

The bottom portion 115 of the carton 100 includes a plurality of complementary locking fingers 130 extending from the bottom portion 115 for engaging the plurality of locking fingers 120 and 125 on the top portion 105, thus securing the top portion 105 and bottom portion 115 of the carton together.

Figure 2:
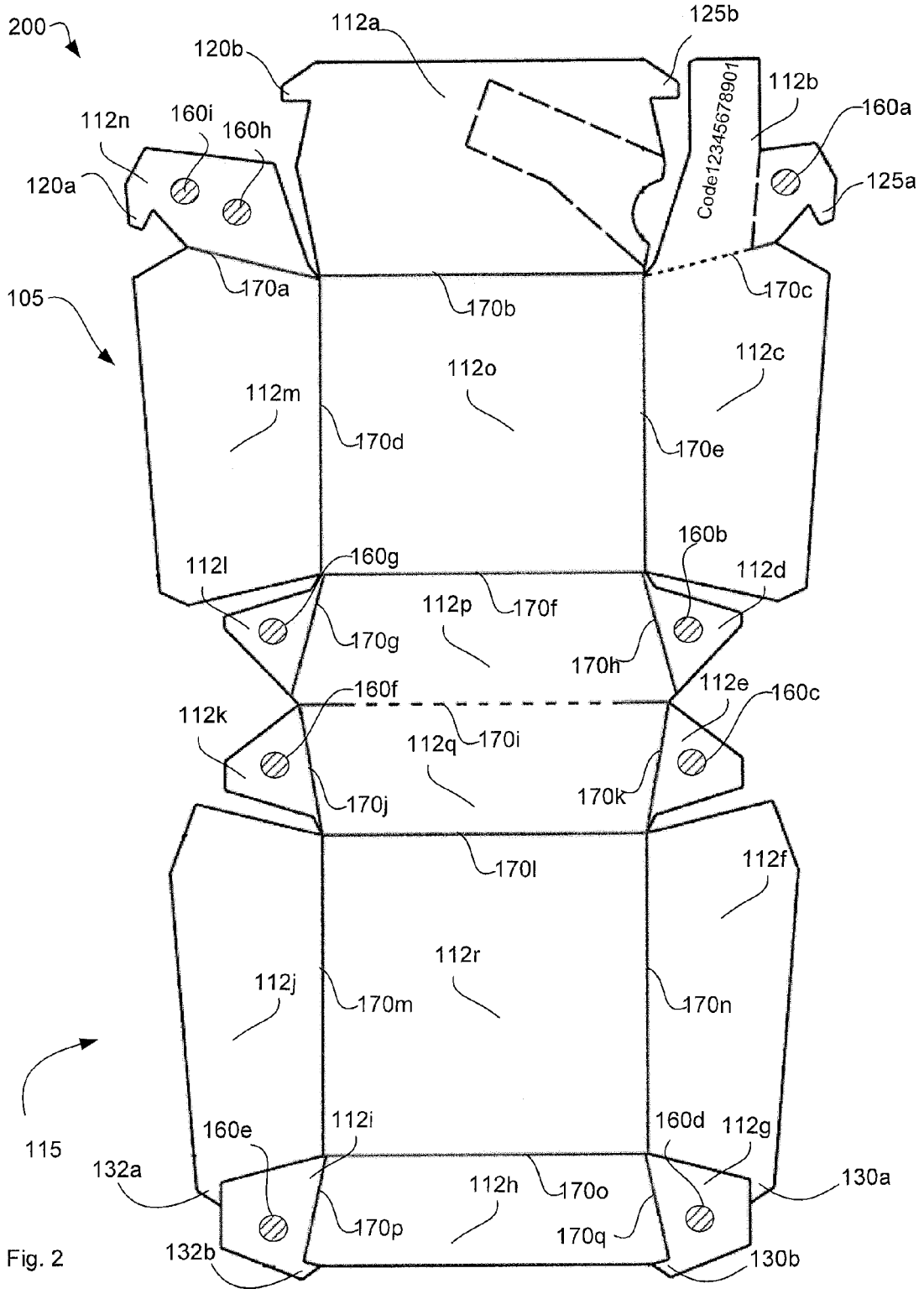
FIG. 2 is a view of a carton form associated with the carton of FIG. 1.
Figure 4:
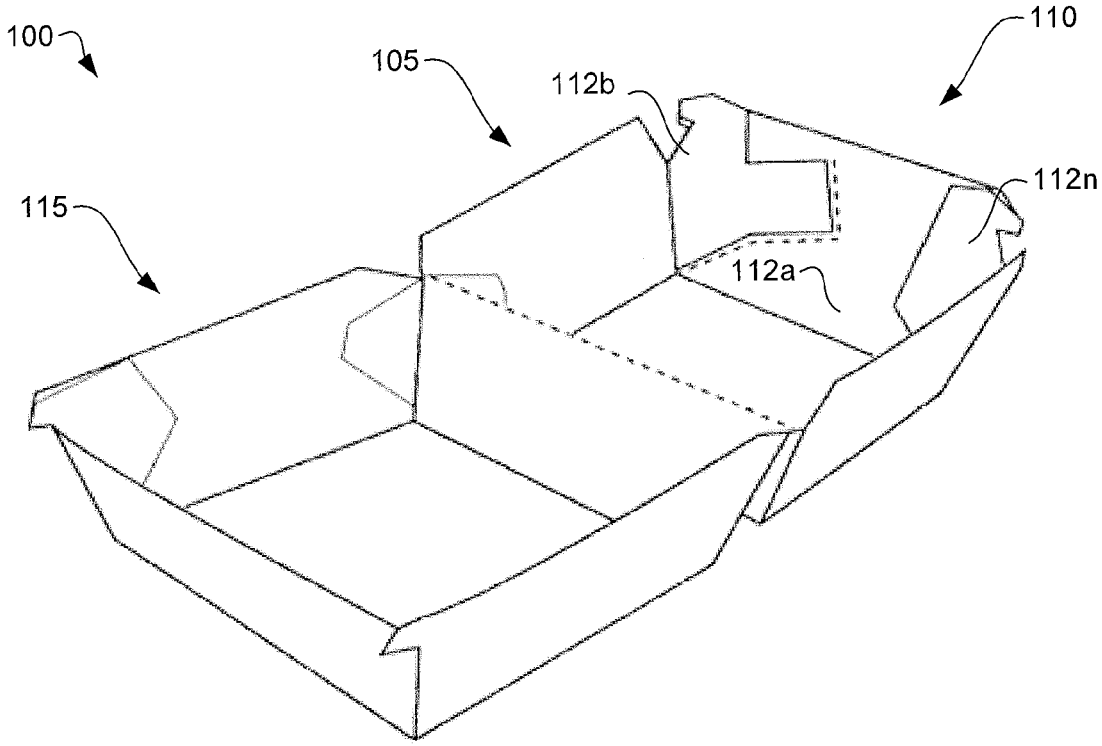
FIG. 4 is a view of the carton of FIG. 1 in an open configuration.

FIG. 2 is a view of the carton 100 of FIG. 1 in an unassembled configuration 200. As shown, the unassembled carton 200 includes a series of creases 170*a-q* that define a plurality of planar regions 112*a-r* that define the carton 100. Also shown are a series of glue dots 160*a-i* that are utilized to bond the plurality of planar regions 112*a-r* to one another. During production, the planar regions 112*a-r* are folded about the creases 170*a-q* resulting in the assembled carton configuration shown in FIG. 4. For example, referring to FIG. 4, the front surface 110 of the carton 100 in the assembled configuration includes the three planar regions 112*a*, 112*b*, and 112*n* shown on the top of FIG. 2. In this case, the right and left upper planar regions 112*b* and 112*h* are disposed behind the center planar region 112*a* when the carton is assembled.

The carton form 200 may be formed from a single sheet of material, such as a corrugated paper material, cardboard, paperboard, plastic or any other material that may creased, folded and bonded, as described above, that is suitably rigid for storing food items.

Referring back to FIG. 2, each of the three regions 112*a*, 112*b*, and 112*h* includes locking finger regions 120*a,b* and 125*a,b*, which when assembled correspond to the locking fingers 120 and 125 shown in FIG. 1. Similarly, the bottom three regions 112*g, h*, I shown in FIG. 2 include locking finger regions 130*a-b* and 132*a-b*, which when assembled correspond to the locking fingers 130 extending from the bottom portion 115 of the carton 100.

Figure 3:
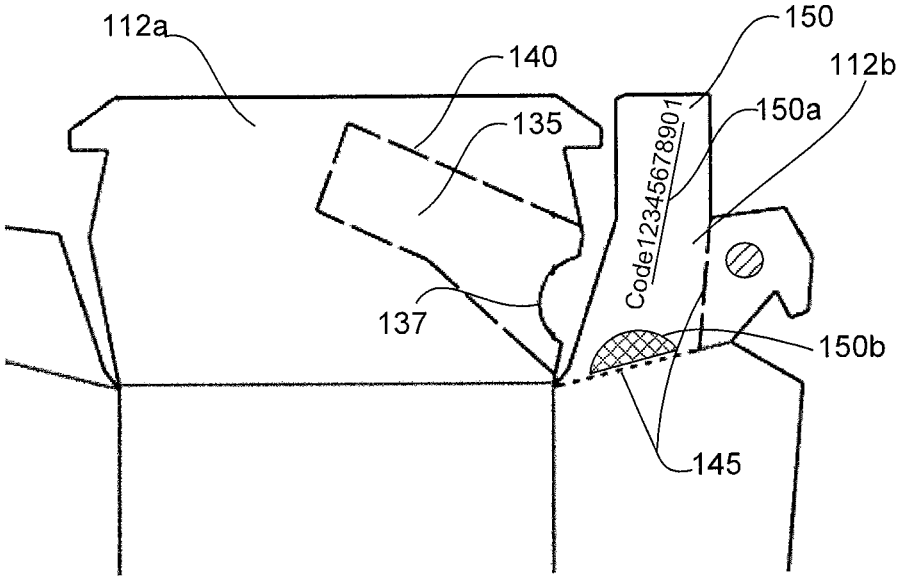
FIG. 3 is a view of the prize information feature on the carton form.

As shown in FIG. 3, the top center region 112*a* of the carton 100 includes a group of perforated edges 140 that define the information tab cover 135. The information tab cover 135 may also define a recess 137 at one end to enable pealing back and/or separating the information tab cover 135 from the center region 112*a* of the carton form 200, which corresponds to the front surface 110 of the carton 100 of FIG. 1. The recess 137 is sized to enable a user to peel back and/or separate the information tab cover 135 with his finger.

The top right region 112*b* of the carton 100 includes a group of perforated edges 145 that define the prize information tab 150. The perforated edges 145 may enable the separation of the prize information tab 150 from the top right region 110*b*, which corresponds to the front surface 110 of the carton 100 of FIG. 1. The prize information tab 150 may be utilized for the placement of, for example, promotional information associated with a prize that a purchaser of the food item contained within the carton 100 may have won. For example, the promotional information may correspond to a code 150*a*. The consumer may go visit a web site and enter the code 150*a* to redeem a prize.

Figure 5A:
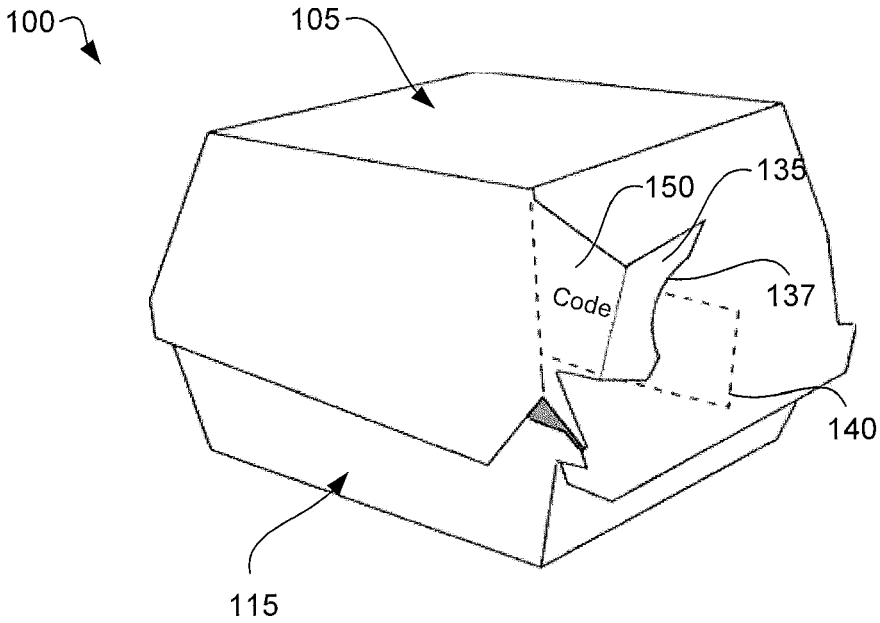
FIG. 5*a* and FIG. 5*b* illustrate the removal of an information cover tab of the carton of FIG. 1.
Figure 5B:
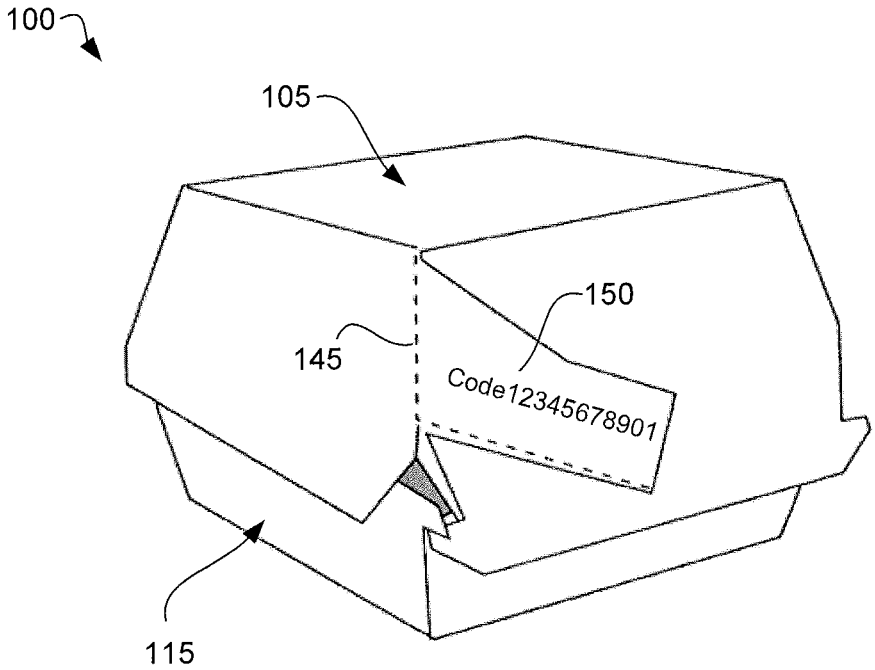

FIGS. 5*a* and 5*b* illustrate an operation of the carton 100. Initially, the information tab cover 135 completely covers the prize information tab 150, thus preventing a user from seeing the prize information. In FIG. 5*a*, the information tab cover 135 may be engaged via a finger recess 137, thus separating the information tab cover 135 along the perforated edges 140 to reveal information printed on the prize information tab 150.

In FIG. 5*b*, the information tab cover 135 is separated entirely from the front surface 110 of the carton 100 so to reveal the information on the prize information tab 150. For example, a code associated with a prize may be printed on the prize information tab 150 and may be completely visible after the information tab cover 135 is removed.

Figure 6:
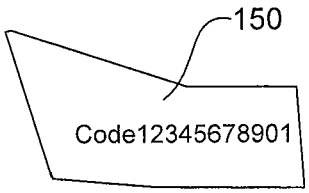
FIG. 6 is a view of a separated prize information tab of the carton of FIG. 1.

In yet another operation, the prize information tab 150 may be removed by separating the prize information tab 150 along the perforated edges 145. An exemplary separated prize information tab 150 is shown in FIG. 6.

Figure 7:
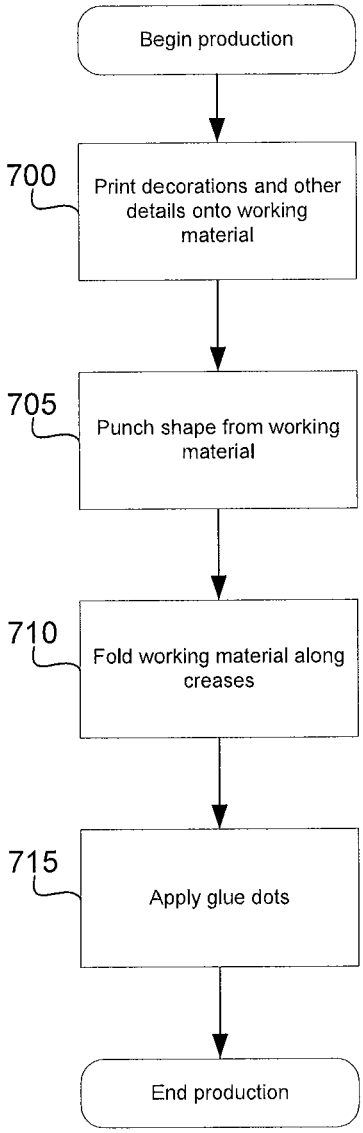
FIG. 7 is a flow diagram illustrating operations involved in the production of the carton of FIG. 1.

FIG. 7 is a flow diagram of exemplary operations carried out during the production of the carton 100 of FIG. 1. At block 700, decorations and other details may be printed on the form. For example, a description of a food item carried in the carton and nutritional information may be printed on the form. In addition, prize information may be printed on the prize information tab.

At block 705, an unassembled carton form is punched from a larger piece of working material. For example, the carton form may correspond to the carton form 200 shown in FIG. 2. The punch may simultaneously cut-out material that is not needed, crease the working material to define regions of the carton, and perforate the working material to define the information tab cover and the prize information tab described above.

At block 710, the various regions defined in the form may be folded along the creases to provide the carton 100 shown in FIG. 3.

At block 715, glue dots may be applied to various regions of the form. The glue dots may be utilized to bond the various regions to one another.

While the carton and method for assembling the carton have been described with reference to certain embodiments, it will be understood by those skilled in the art that various changes may be made and equivalents may be substituted without departing from the scope. For example, the carton described above may be utilized for items other than food. In addition, the operations in manufacturing the carton may be done in a different order. For example, decorations and other details may be printed on the carton form after the carton form is punched from the working material, or the glue dots may be applied earlier than the other operations.

In addition, many modifications may be made to adapt a particular situation or material to the teachings without departing from its scope. Therefore, it is intended that the present method and system not be limited to the particular embodiment disclosed, but that the method and system include all embodiments falling within the scope of the appended claims.

We claim:

1. A carton comprising:

a top portion and a bottom portion configured to secure an item within the top and the bottom portion when the carton is in a closed configuration;

a first surface that includes a first portion that defines a removable information tab and a second portion; and a second surface that includes a first portion that defines a removable information tab cover and a second portion that is configured to be adhered to the second portion of the first surface to secure the first surface to the second surface, wherein the first and second surfaces remain secured to one another when either or both of the information tab and the information tab cover are removed, wherein the first surface and the second surface are provided on at least one of the top portion and the bottom portion of the carton, wherein in an unassembled configuration of the carton, a surface of the information tab is exposed to enable placement of information on the information tab, and wherein in an assembled configuration of the carton the information tab cover covers the surface of the information tab so that the information placed on the information tab is not visible, wherein the carton is assembled from a single planar carton form being a single sheet of material that includes the first surface and the second surface, wherein the carton form has a first planar region, which when the carton form is assembled into a carton becomes a front surface of the carton, wherein the carton form has a second planar region that forms a side surface of the carton, wherein the carton form has a third planar region directly connected to the second planar region via a crease, and wherein the first surface that defines the information tab is formed in the third planar region, and wherein said second surface defining the information tab cover is formed in said first planar region.

2. The carton according to claim 1, wherein the information tab is configured to be removable from the first surface.

3. The carton according to claim 1, wherein the information tab cover defines a recess configured to be engaged by a finger of a user to enable removal of the information tab by the user.

4. The carton according to claim 1, wherein the carton is made of corrugated paper material.

5. The carton according to claim 1, wherein the information tab cover covers the surface the information tab, which is connected to the second planar region via a crease by the third planar region being folded along a crease between the third planar region and the second planar region such that the third planar region is folded behind the first planar region.

6. The carton according to claim 1, further comprising a first group of perforated edges disposed on the first surface that define the information tab.

7. The carton according to claim 1, further comprising a second group of perforated edges disposed on the second surface that define the information tab cover.

8. The carton according to claim 1, further comprising a single sheet of material that includes the first surface and the second surface.

* * * * *